US007946684B2

(12) United States Patent
Drury et al.

(10) Patent No.: US 7,946,684 B2
(45) Date of Patent: May 24, 2011

(54) METHOD OF MANUFACTURE AND PRINTER WITH ELASTIC ALIGNMENT FEATURES

(75) Inventors: Paul R. Drury, Hertfordshire (GB); Robert J. Lowe, Cambridge (GB); Stephen Temple, Cambridge (GB)

(73) Assignee: Xaar Technology Limited, Cambridgeshire (GB)

( * ) Notice: Subject to any disclaimer, the term of this patent is extended or adjusted under 35 U.S.C. 154(b) by 1069 days.

(21) Appl. No.: 11/632,753

(22) PCT Filed: Jul. 25, 2005

(86) PCT No.: PCT/GB2005/002923

§ 371 (c)(1),
(2), (4) Date: Apr. 19, 2007

(87) PCT Pub. No.: WO2006/008555

PCT Pub. Date: Jan. 26, 2006

(65) Prior Publication Data

US 2008/0094447 A1 Apr. 24, 2008

(30) Foreign Application Priority Data

Jul. 23, 2004 (GB) ..... 0416523.9

(51) Int. Cl.
*B41J 2/14* (2006.01)
*B41J 2/16* (2006.01)

(52) U.S. Cl. ..... 347/49; 347/42

(58) Field of Classification Search ..... 347/20, 347/40, 42, 49, 56, 61–65, 67
See application file for complete search history.

(56) References Cited

U.S. PATENT DOCUMENTS 6,533,391 B1 * 3/2003 Pan ..... 347/42

FOREIGN PATENT DOCUMENTS

| | | | |
|---|---|---|---|
| EP | 0 666 174 | A2 | 8/1995 |
| JP | 3459129 | A | 10/1995 |
| JP | 2005-500192 | T | 1/2005 |
| WO | WO-99/10179 | | 3/1999 |
| WO | WO-03/018317 | | 3/2003 |

OTHER PUBLICATIONS

International Preliminary Report on Patentability for International Application No. PCT/GB2005/002923, dated Apr. 7, 2006.
International Search Report for International Application No. PCT/GB2005/002923, dated Apr. 7, 2006.

* cited by examiner

*Primary Examiner* — Juanita D Stephens
(74) *Attorney, Agent, or Firm* — Marshall, Gerstein & Borun LLP

(57) ABSTRACT

A method of manufacture of printers and printheads formed of a number of modules mounted on a chassis. The modules and chassis are formed with a number of alignment features which engage with one another to form elastic interference couplings. By arranging a number n of such couplings for each module, the variance in positional error of each module with respect to the chassis can be made significantly less than the alignment error of the alignment features themselves, by the process of Average Elastic Alignment. The elastic interference couplings can advantageously be made to form a sealed coupling for the supply of ink from the chassis to each module.

30 Claims, 11 Drawing Sheets

METHOD OF MANUFACTURE AND PRINTER WITH ELASTIC ALIGNMENT FEATURES

BACKGROUND OF THE INVENTION

1. Field of the Invention

The invention relates methods of manufacture, particularly of printers and of droplet deposition inkjet printers.

2. Related Technology

Inkjet printers are capable of ejecting a small droplet of fluid onto a substrate. The fluid has particular properties and while it is typically called an "ink", it may be colourless and/or contain biological or some other functional component. The ability of inkjet printers to eject such a wide variety of "inks" means that the print heads, the part of the printer which ejects the ink, come in a number of different shapes and sizes. Some print heads have as few as 16 ejection elements while others may have over 2000.

An ejection element typically comprises a number of components. The first is an orifice or nozzle through which the droplet fluid is ejected towards the substrate. The second component is an ejection chamber that contains the fluid to be ejected. The third component is an actuator that pressurises the fluid in the chamber and effects the ejection of the fluid through the orifice. The actuators are typically mechanical or thermal. A further component is a fluid supply that supplies ink to the ejection chambers. The fluid supply may cause ink to flow continually through the ejection chamber.

Failure or errors in even a single ejection element may require the print head to be scrapped. Failures may occur in operation e.g. a permanent blockage in the orifice, damage to the nozzle plate etc. or during manufacture e.g. electrical faults or some other defect. It is well known that the greater the number of ejection elements the greater the statistical chance of that print head needing to be scrapped because of a fault. The manufacturing yield of large print heads can be low.

It has been proposed, to improve yield in larger print heads, to manufacture the print head from a plurality of smaller modules rather than from one large print head. Each module may be pre-tested before mounting onto a substrate enabling the overall yield of the large print head to be improved.

The modules must be capable of being manufactured to a high accuracy relative to one another. The high accuracy ensures that a first module provides the same functional capability as a second module in terms of, for example jet straightness, ejection speed etc. Modules should also have a high repeatability with respect to one another to allow a first module to replace a second module without significant re-alignment.

Techniques are proposed in the prior art to provide modules with such repeatability and accuracy. In WO 99/10179, repeatability is achieved by completing the print head and subsequently adhering a datum feature on the print head at a predetermined position relative to a nozzle or actuator. As each print head has a datum feature in the predetermined position relative to the nozzle it is possible to use the datum feature to locate the print head in the printer.

It will be appreciated that with this technique it can take some time to align each datum relative to the print head and additionally adds a further manufacturing step. The datum feature must be aligned in the printer to both a high repeatability and high accuracy.

GENERAL DESCRIPTION OF THE INVENTION

The invention provides an improved method of aligning a module in a print head. The invention also provides an improved print head comprising a module. Further, the invention provides an improved method of manufacturing a module for a print head. The invention also provides an improved print head module for an inkjet print head.

According to a first aspect, the invention provides a method for providing repeatability for replacement print head modules in a printer, said method comprising the steps:

providing a plurality of modules making up a population, each module of the population comprising a plurality of alignment features and comprising a print element, wherein the population has a mean print element position and a variance from the mean print element position;

providing a chassis comprising a plurality of complementary alignment features; and bringing the alignment features of one of the modules in the population and complementary alignment features into contact thereby forming n interference couplings, the n interference couplings having a mean position and an individual variance from the mean position;

wherein the variance of the print element position from the mean print element position is less than or equal to the variance of the individual interference couplings from the mean interference coupling position.

An interference coupling is preferably provided by the joining of an alignment feature and a complementary alignment feature. At least one of the alignment feature and complementary alignment feature exhibits sufficient elasticity such that portions of it is either compressed or stretched by the other feature that is brought into contact with it. Preferably both features are partially compressed, stretched or both, the relative elasticities being either similar or different.

By providing a relatively large number of interference couplings the relative elasticity of each of the couplings allow for errors in the size and position of each coupling to be averaged out over the sum of the couplings by a process of Averaged Elastic Alignment (AEA).

Each object in a print head has a position where it actually is and a position where it ought to be. The difference between these two positions is its positional error. Objects will have a positional error distribution according to their method of manufacture. This parent population distribution (X) will have a mean ($\mu_x$) positional error and a variance ($\sigma^2_x$) of positional error. A measured instance of an object will have a particular positional error, $x_i$.

For a normally distributed parent population, n instances of a particular object are grouped together to form a sample of size n from the parent distribution. The average (mean) positional error of this sample ($\overline{x}$), by the central limit theorem, will follow the distribution:

$$N(0, 1) \sim \frac{\overline{x} - \mu}{\sigma / \sqrt{n}}$$

where N(0,1) is the standard normal distribution.

As n tends to infinity then $\overline{x}$ tends to $\mu$ then and there is no deviation of the sample average positional error from the population mean. Beneficially, if a large number of elastic alignment features are provided between a print head and a base then it is possible to ensure that the print head and base may be aligned to a high repeatability.

It is not necessary for the complementary alignment features to have the same or even similar elasticity to the alignment features. Where the complementary alignment features have a significantly higher stiffness to the alignment features, it is the complementary alignment features that dominate the position of the interference couplings, though elastic averaging will still occur through the alignment features.

More robust complementary alignment features provide particular benefit during manufacture. The features are provided on a jig or other base and thus must withstand repeated contact with the alignment features of a number of different modules. Choosing an appropriate material of increased stiffness makes the complementary alignment features more robust and able to withstand the repeated removal and replacement of print head modules or other components having alignment features.

Since each module is aligned to the same average position on the jig then, provided that the work performed on the module can be controlled to a high degree of accuracy, the work has a high module to module accuracy. Similarly, since the module can then be placed in the printer in a position that has been averaged to approach the population mean, each module has high replacement repeatability.

The elastic alignment features may preferably be formed of either metal or plastic.

The n interference couplings may be formed by bringing together $n_1$ alignment features and $n_2$ complementary alignment features; where $n_1$ and $n_2$ may be (but need not be) the same as n. Each alignment feature or complementary alignment feature may comprise a plurality of elastic sub-alignment features.

The variance of the print element from the mean print element position is less than or equal to 1/n. The print element may be an actuator element or a nozzle.

In a preferred embodiment the interference coupling also provides a fluid coupling for supplying fluid from the print head chassis to an ejection chamber in the module. Beneficially, one of the jigs in manufacture may be a "print-test" jig that can measure and test each module and the print quality of each module. The ability to repeatedly make and break the interference couplings enables this.

The stiffness of one or more of the interference couplings may be selectively adjusted i.e. it may be increased or decreased. The selective adjustment alters the mean interference coupling position. The selective adjustment may be to increase or decrease the stiffness of at least one interference coupling.

As the position of the individual alignment features approach the sample mean, it is possible for the features to be manufactured to a lower tolerance. For example, injection moulding may form the features any errors being averaged over the Sample Population. The tolerance has an effect on the number of alignment features that are required to achieve an appropriate averaging effect. The variance reduces in the error of positioning a module which has n couplings is reduced as compared with the variance in each alignment feature by $1/\sqrt{n}$. For a feature that is repeatable to $3\sigma=2$ μm, 4 features are required. For a feature repeatable to $3\sigma=10$ μm, 100 features are required.

According to a second aspect, the invention provides a method for manufacture, said method comprising the steps:

providing a module comprising a plurality of elastic alignment features, providing a base comprising a plurality of first complementary alignment features, and bringing the module and the base into contact such that said elastic alignment features and said first complementary alignment features form $n_1$ first interference couplings, performing a manufacturing action on said print head module at one or more locations relative to a datum, breaking said interference couplings, thereby removing the module from said base, and providing a chassis comprising a plurality of second complementary alignment features, and bringing the module and the chassis into contact such that said elastic alignment features and said second complementary alignment features form $n_2$ second interference couplings.

The module may be a print head module, the datum may be provided on the base or the module.

According to a third aspect, the invention provides a method for forming a printer, said method comprising the steps:

providing a print head module comprising a plurality of elastic alignment features, providing a base comprising a plurality of first complementary alignment features, and bringing the print head module and the base into contact such that said elastic alignment features and said first complementary alignment features form $n_1$ first interference couplings, performing a manufacturing action on said print head module at one or more locations relative to a datum on the base, breaking said interference couplings, thereby removing the print head module from said base, and providing a chassis comprising a plurality of second complementary alignment features, and forming said printer by bringing the print head module and the chassis into contact such that said elastic alignment features and said second complementary alignment features form $n_2$ second interference couplings.

Preferably at least one of said alignment features and said first or second complementary alignment features provide a degree of elasticity. Even more preferably the alignment features are elastic alignment features. It is preferred that the first complementary alignment features are significantly stiffer than the alignment features.

Preferably $n_1=n_2$ and each of the interference couplings is formed of an identical number of alignment features and complementary alignment features. Preferably the first complementary alignment features have the same dimensions and shape as the second complementary alignment features.

The base may be a jig that travels with the print head module throughout manufacture or a plurality of bases may be provided, each with complementary alignment features, the print head module being transferred from base to base by repeated making and breaking of interference couplings.

The manufacturing action may be, for example, the formation of a nozzle by etching, ablation etc. or manufacture of an ejection actuator by sawing, deposition or other known technique.

The alignment features and second complementary alignment features may form a coupling through which ejection fluid may be supplied to the print head module. The coupling may be self-sealing.

According to a fourth aspect, the invention provides a method of aligning two components comprising the steps:

providing a first component having a plurality of elastic alignment features providing a second component having complementary alignment features bringing said elastic alignment features and said complementary alignment features into contact, thereby forming an interference coupling, and selectively altering the stiffness of at least one of said plurality of elastic alignment features thereby moving the first component relative to said second component.

According to a fifth aspect, the invention provides a method of aligning two components comprising the steps:

providing a first component having a plurality of elastic alignment features providing a second component having complementary alignment features bringing said elastic alignment features and said complementary alignment features into contact, thereby forming a interference coupling, and selectively adjusting at least a portion of said interference coupling thereby moving the first component relative to said second component.

According to a sixth aspect, the invention provides a print head comprising a replaceable module mounted on a chassis, said module comprising a plurality of ejection chambers and a plurality of n elastic supply ports for the supply of fluid to said ejection chambers, said chassis comprising a plurality of n complementary supply ports wherein said elastic supply ports and said complementary supply ports together provide an interference coupling having a bore, said bore allowing fluidical communication between an ejection chamber and an ink supply.

BRIEF DESCRIPTION OF THE DRAWINGS

The invention will now be described by way of example only and with reference to the following figures in which.

DETAILED DESCRIPTION

Figure 1:
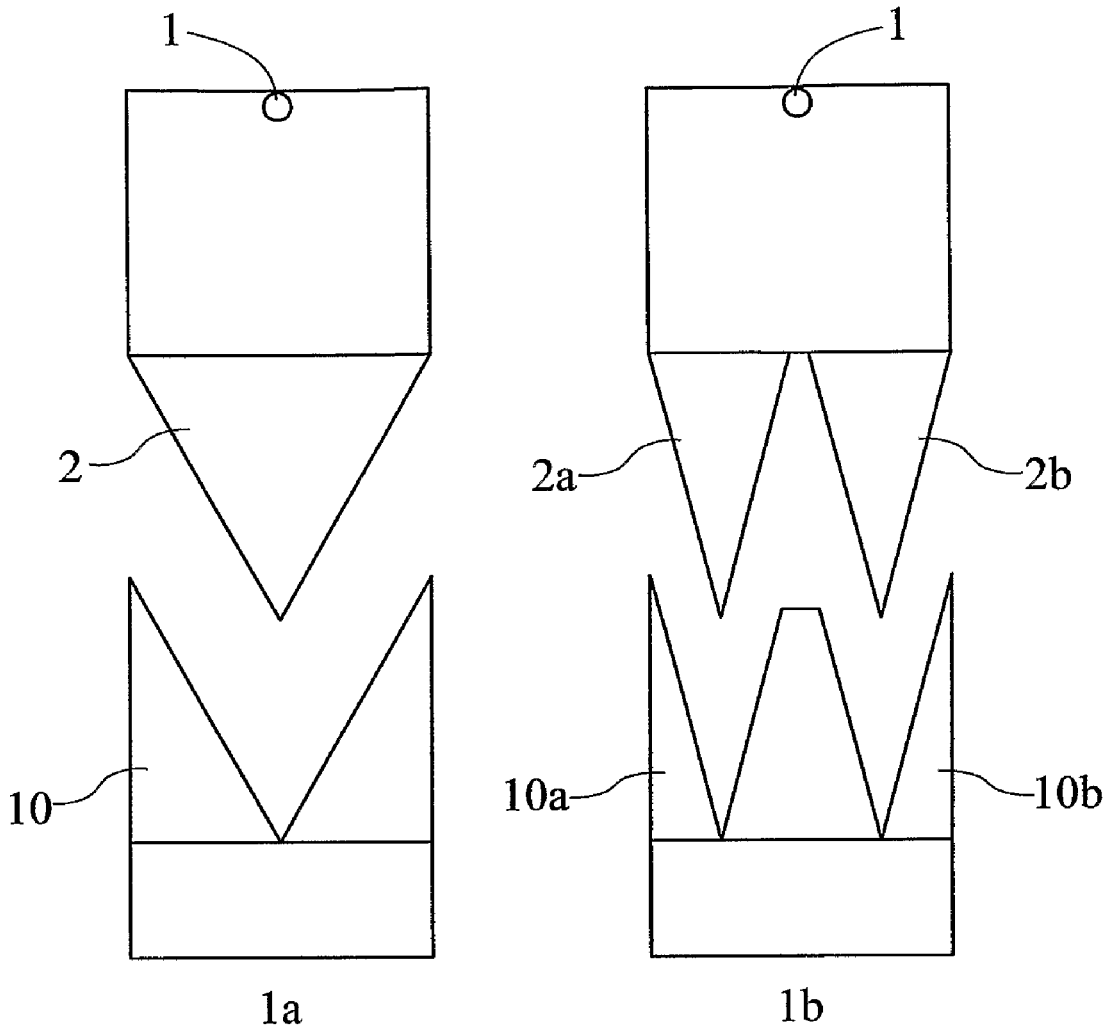
FIG. 1 is a schematic view of two print head modules.

FIG. 1 is a schematic drawing of a module and a chassis having a single alignment feature 2 and complementary alignment feature 10 (FIG. 1*a*) and a module and a chassis having two alignment features 2*a*,2*b* and two complementary alignment features 10*a*, 10*b* (FIG. 1*b*).

Each of the alignment features and complementary alignment features has a positional error caused, in part, by the manufacturing method. The total number of alignment features and complementary alignment features provide a sample population that has a mean positional error.

The positional error may be in one or more of the X, Y and Z directions; the X direction being along the length of the print head, the Y direction in the direction of paper travel and the Z direction in the direction of droplet travel.

The positional errors of the alignment features and complementary alignment features have a distribution around the mean positional error. The distribution has been found to be a normal distribution, but other distributions such as, for example, a t-distribution can be approximated by the normal distribution.

The mean positional error for the sample population ($\bar{x}$) follows the normal distribution:

$$N(0, 1) \sim \frac{\bar{x} - \mu}{\sigma / \sqrt{n}}$$

Where:

n is the number of items in the sample population $\mu$ is the mean positional error for the population, and $\sigma^2$ is the variance in that positional error for the population.

As $n \to \infty$ then $\bar{x} \to \mu$ then and there is no deviation of the sample average positional error from the population mean.

A nozzle 1 is formed in the print head module at a predetermined location relative to the mean position of the alignment feature 2 or features 2*a*, 2*b*. The nozzle is formed by laser processing and this is an exact technique that can locate the nozzle at a high repeatability relative to the nominated point or population mean.

Every module that is produced will have alignment features, or a plurality of alignment features that have a different population mean. From the above equation, where n=1 and the nozzle is accurately aligned relative to the single datum feature the position of the nozzle has the same standard deviation as the alignment features of the module sample population. Again, from the above equation and discussion by providing a higher number for n the population has the effect of averaging out the population mean. Thus, where the nozzle can be formed to a high repeatability relative to the population mean it is possible to locate the nozzle at a higher module to module repeatability than the repeatability of the individual alignment features.

The alignment features 2, 2*a*, 2*b* are brought into contact with the complementary alignment features 10, 10*a*, 10*b* to form interference couplings. The alignment features 2, 2*a*, 2*b* have an elasticity that cause them to deform upon contact with the complementary alignment features. The deformation of one or both of the alignment features/complementary alignment features is one characteristic of an interference coupling. A second characteristic is that discrepancies between individual interference couplings are averaged out over the number of interference couplings.

The nozzle may also be aligned relative to the locations of the interference couplings. These will have, due to the elastic nature of either the alignment features or complementary alignment features, slightly different locations to either of these features. The locations of the interference couplings will have positional errors that depend, in part, on the location of the alignment and complementary alignment features. This follows a distribution:

$$X_3 = X_1 - X_2$$

Where $X_1$ is the distribution of the alignment features, $X_2$ the distribution of the complementary alignment features and $X_3$ the alignment error difference.

The mean positional error for each interference coupling is:

$$\mu_{X3} = \mu_{X1} - \mu_{N2}$$

and the variance of positional error is:

$$\sigma_{X3}^2 = \sigma_{X1}^2 + \sigma_{X2}^2$$

The mean positional error for the sample population ($\bar{x}$) follows the normal distribution:

$$N(0,1) \sim \frac{\bar{x}_3 - \mu_{x3}}{\sqrt{\sigma_{x3}^2} / \sqrt{n}}$$

Once again, as the number of features n increases the average positional error of the sample tends towards the average population mean, enabling a high repeatability of nozzle position when aligned relative to the average population mean. Different modules will form interference couplings having the same sample mean to enable high repeatability between modules.

Where one of the alignment features or complementary alignment features is significantly stiffer than the other feature then the stiffer feature will tend to dominate the location of the population mean.

Figure 2:
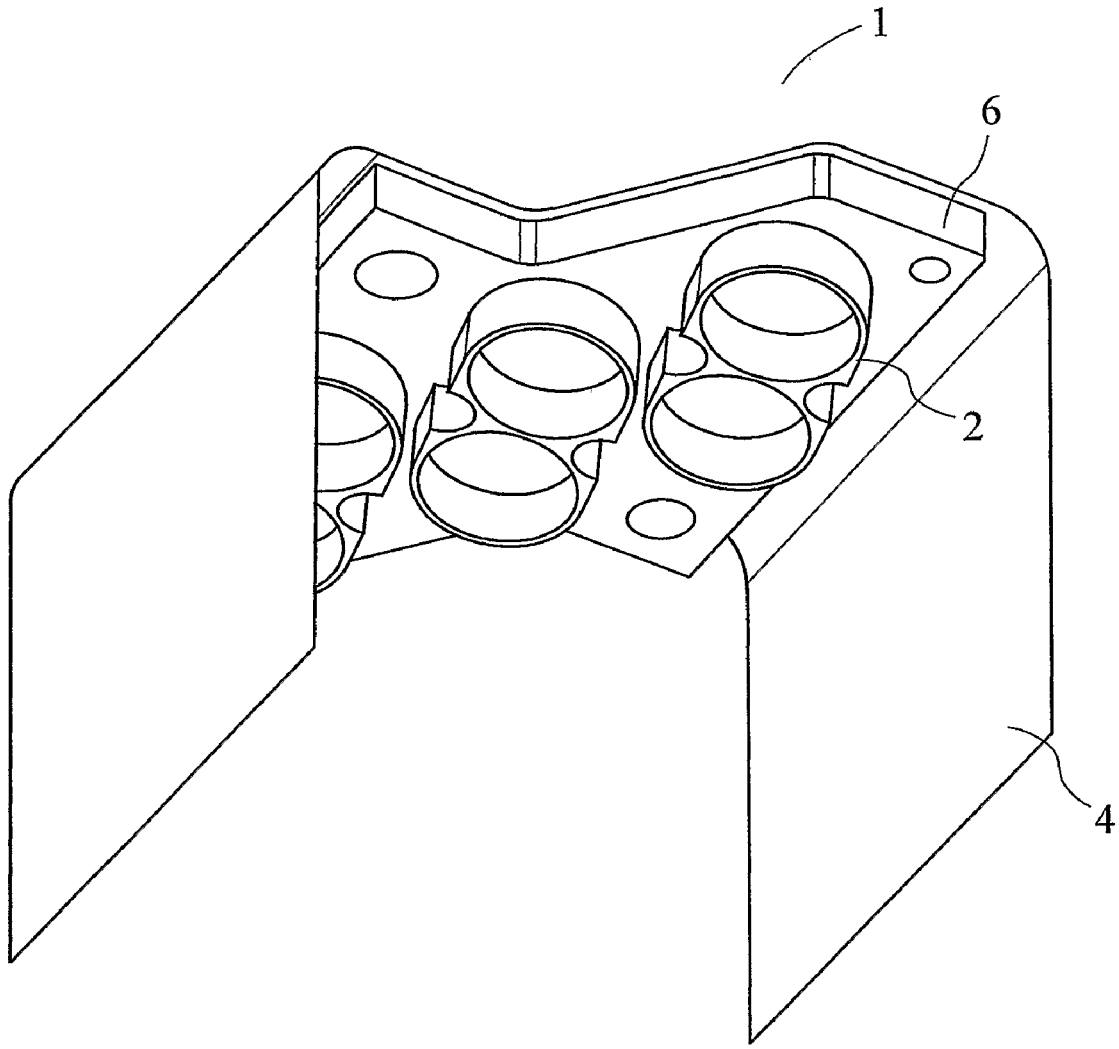
FIG. 2 is a perspective view of a print head module.

FIG. 2 depicts a perspective view of a print head module according to the present invention. The module consists of injection moulded alignment features 2 formed as part of an actuator support plate 6.

Piezoelectric actuators (not shown) are mounted to the support plate and a flexible circuit 4 supplies the actuators with drive signals. An ejection chamber is provided in an associated arrangement with the actuators, the actuators acting upon the ejection chamber to alter the volume thereof. The variation in volume causes a droplet of ink to be ejected from nozzles (not shown) which communicate with respective ejection chambers.

Figure 3:
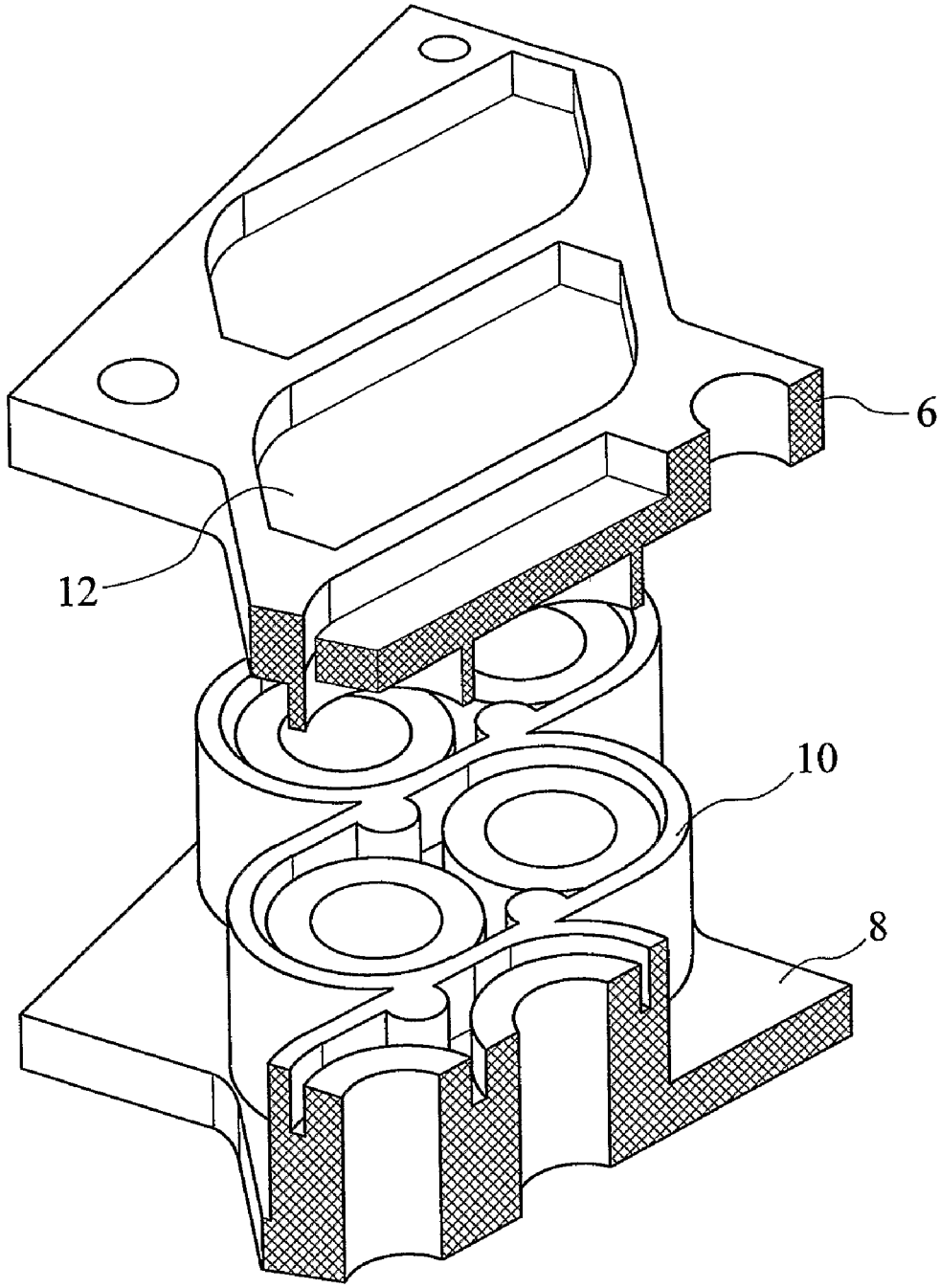
FIG. 3 is a perspective view of a chassis component and a print head module.

FIG. 3 depicts a perspective view of the chassis component 8 and the print head module support 6. Complementary alignment features 10 are provided as part of the chassis. A bore extends through the alignment features 2 and the complementary alignment features 10 allowing fluid to pass to the print head module. Manifolds 12 are provided in the actuator support plate for receiving the fluid. The chassis component is provided with two fluid bores per manifold to allow a circulation of ink through the manifold.

The alignment features on the module and the complementary alignment features on the chassis together form interference couplings. The elasticity of the alignment features on the print head module enables the alignment features on the module to be compressed, or expanded, by the complementary alignment features. This helps to hold the components together and also provides a seal preventing fluid leakage though additional clamping may also be provided.

The alignment features and the complementary alignment features are joined to form n interference couplings, in the case of FIG. 2 and FIG. 3, n=6. In this example, the elasticity of the alignment features and the complementary alignment features are substantially identical. The elastic nature of the alignment and the complementary alignment features allows for each to be shifted slightly with respect to each other to average out any differences.

By providing a large number of interference couplings between the print head module and the base it is possible to average out positional errors to the population mean. Beneficially this means that the alignment features of the modules may be formed using less accurate techniques and this reduces the cost per module.

The number of alignment features further improves the repeatability of the actual position of module location. The variance of the position goes as 1/n and the standard deviation as $1/\sqrt{n}$. For a target tolerance of 1 μm and a feature that is repeatable to 2 μm then 4 features are required to ensure repeatability. If the feature is repeatable to 10 μm then 100 features will be required to ensure a similar degree of repeatability.

The interference couplings are designed to be breakable in that the print head module and the base may be separated. This both enables a replacement module to joined to the base should a first module display unwanted effects such as blocked nozzles, defective actuators etc. As replacement modules have a high repeatability, the new module will not require additional alignment, the simple plug and place will be sufficient. A manufacturing process that uses the beneficial ability to break and re-form the interference couplings will be described in greater detail with reference to FIG. 4.

Figure 4:
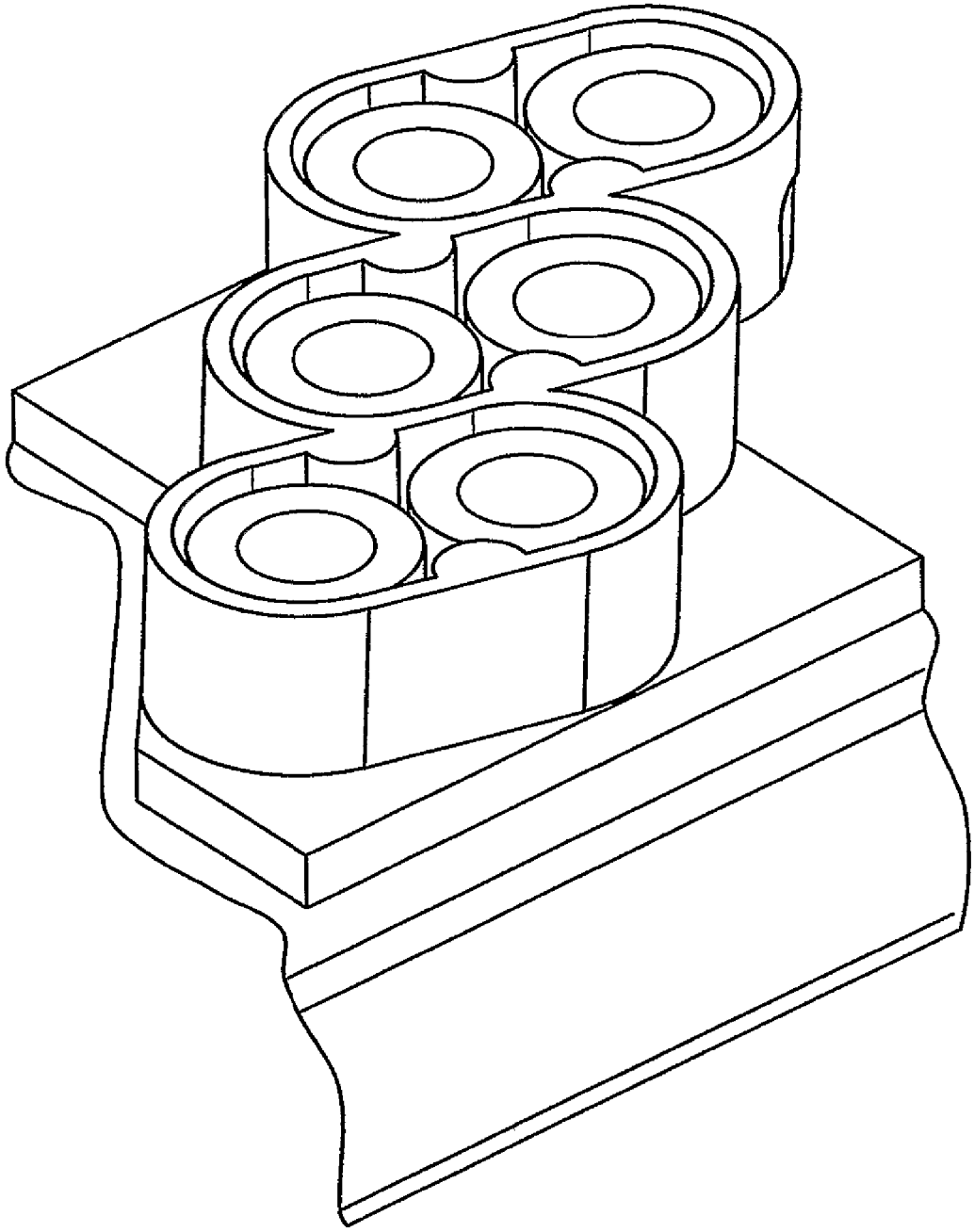
FIG. 4 is a perspective view of a manufacturing jig.

FIG. 4 depicts a jig having complementary alignment features. A non-completed print head module (not shown) is attached to the module by the formation of interference couplings between alignment features on the module and the complementary alignment features. Beneficially, the jig can have similar complementary alignment features to those that will be provided on the future printer. The interference couplings are breakable and thus a similar degree of averaging of the mean feature position may be provided both between the jig and the module and the printer chassis and the module.

A datum is provided either on the print head module itself, or more preferably on the jig and a manufacturing step performed at a position relative to the datum. As modules can be placed onto the jig at high repeatability because of the averaged alignment it is possible to accurately perform the manufacturing step to the same high degree of repeatability.

For example, a laser is used to manufacture nozzles through which ink is ejected from an ejection chamber. The laser can be controlled to form nozzle at positions having a high degree of repeatability relative to the datum on the jig.

Each module is aligned on the jig using the same alignment features that will be used to align the print head module to the printer. The alignment of these features are averaged and consequently modules are formed that may be automatically aligned by the alignment features upon insertion of the print head module. Similarly, print head modules may be moved between jigs to a high degree of repeatability. This enables different manufacturing steps to be performed on while the modules are mounted on different jigs.

The jigs are manufactured to a high tolerance and repeatability relative to one another and the high stiffness of the complementary alignment features relative to the alignment features of the module ensure that the accurately formed features on the jig provide the dominant sample mean.

Figure 5:
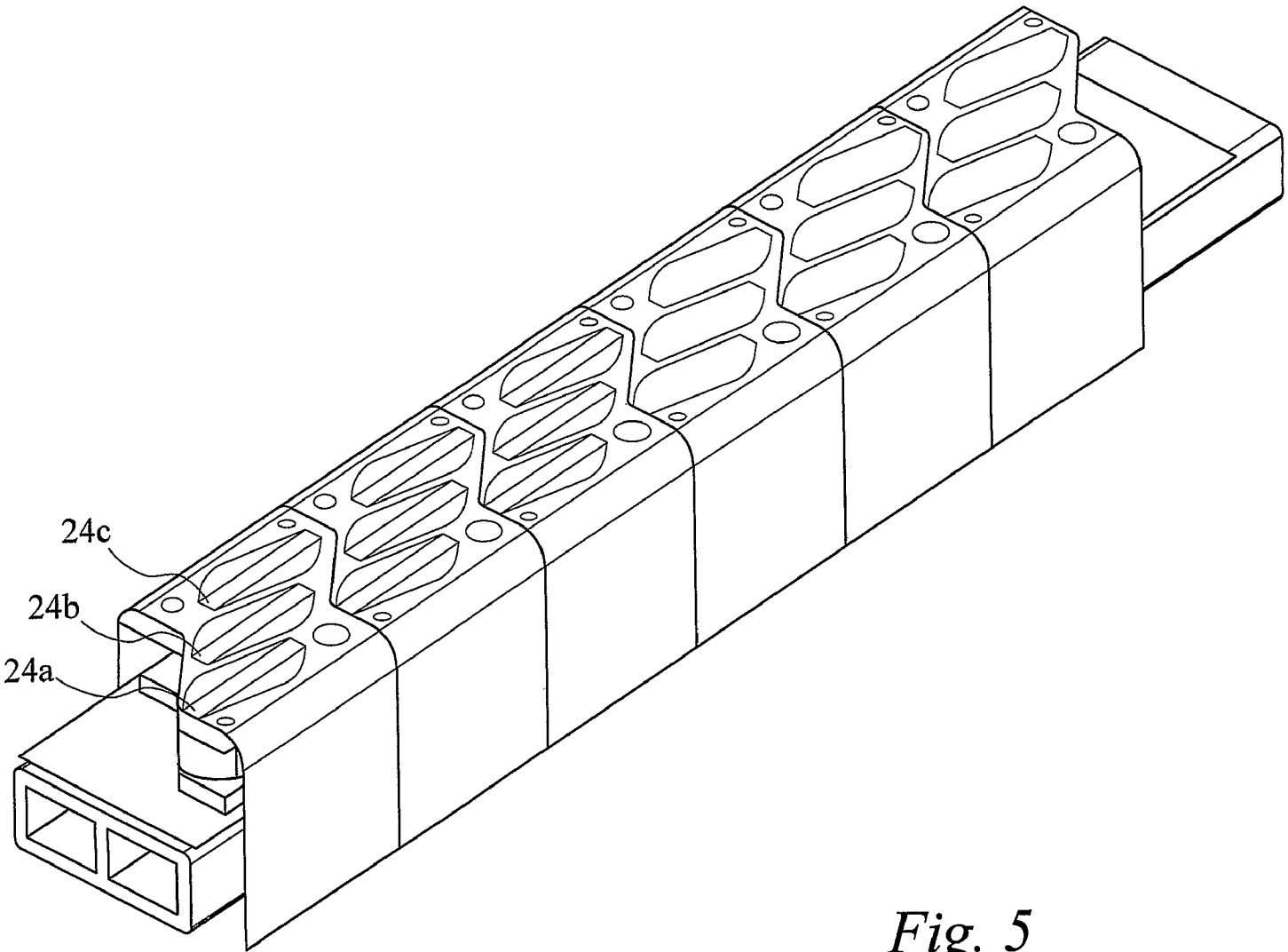
FIG. 5 is a perspective view of a print head substrate with mounted chassis and print head modules.

FIG. 5 depicts a completed print head with all the modules in place. Each module has three rows of ejection elements 24*a*, 24*b* and 24*c*. The central row of ejection elements 24*b* interleaves the ejection elements of the outer rows 24*a* and 24*c* thereby doubling the ejection density.

Figure 6:
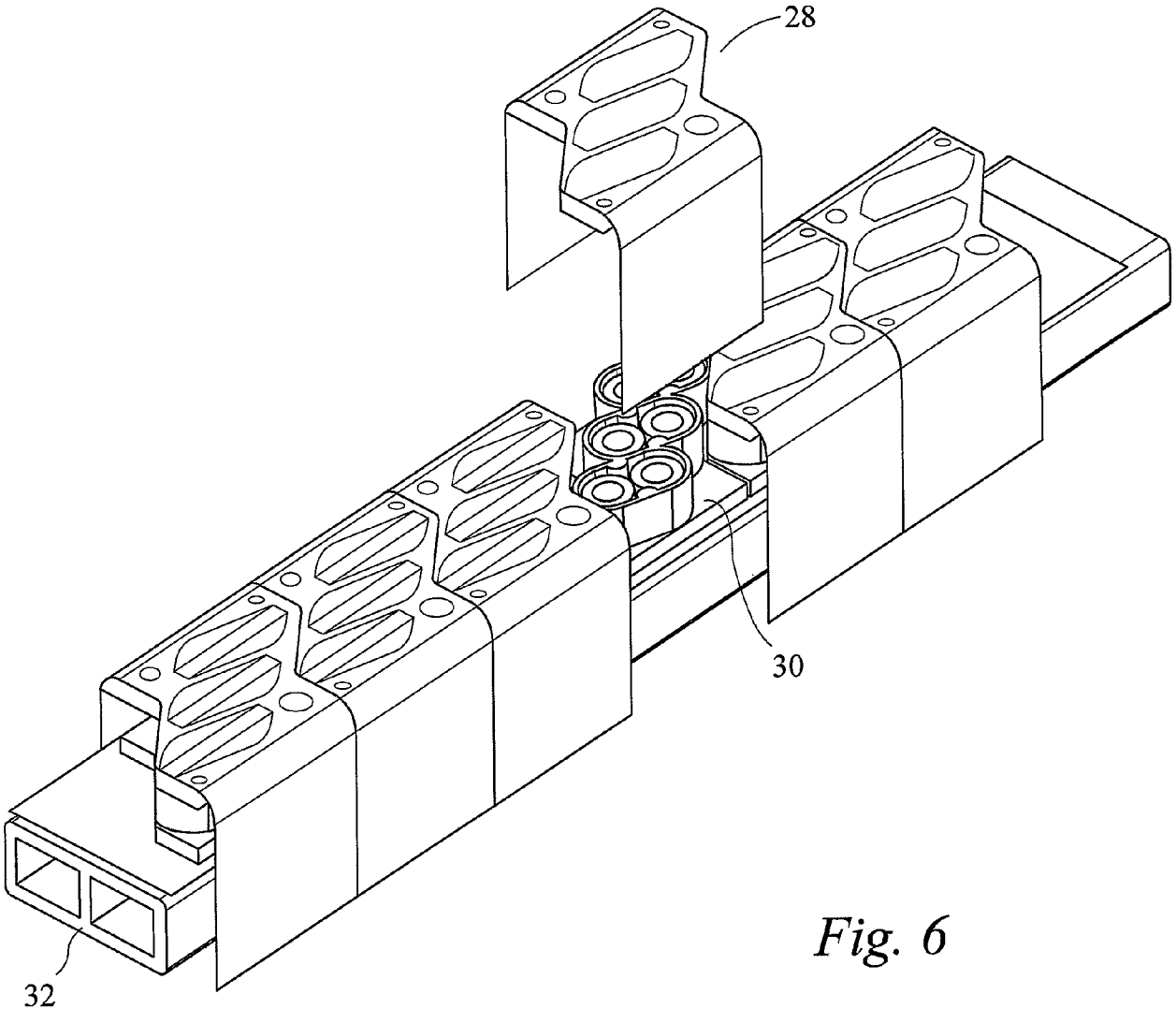
FIG. 6 is a perspective view of chassis with a replaceable print head module.

In FIG. 6 the frictional coupling may be broken by applying a force to separate the module 28 and the chassis 30. This breaking of the coupling does not damage the complementary alignment features on the chassis and a new and pre tested module may be reattached to the chassis using the same complementary alignment features. The alignment features of the new module are structurally the same as the alignment features on the replaced module. Therefore, the alignment of the new module on the chassis is the same as the alignment of the replaced module on the chassis and no complex equipment is required.

The supply support 32 is formed as an extrusion onto which is mounted a number of chassis elements. It is important that these are aligned relative to one another and this alignment is achieved using averaged elastic alignment. A piece of tooling is made to a very high accuracy using, for example wire cutting and is provided with alignment features similar to those found on the print head modules. Each chassis piece is plugged into the tooling through the formation of interference couplings thereby forming an aligned array of chassis components. An adhesive is applied to the underside of each chassis piece and the aligned array of chassis components are simultaneously bonded to the supply support. Once the adhesive has set, the tooling may be removed from the chassis components leaving them bonded to the supply support.

Where a particularly high degree of accuracy or repeatability is required it is possible to selectively alter the alignment features, complementary alignment features or interference couplings. The selective adjustment may similarly be applicable to align groups of modular print heads in a printer.

Figure 7:
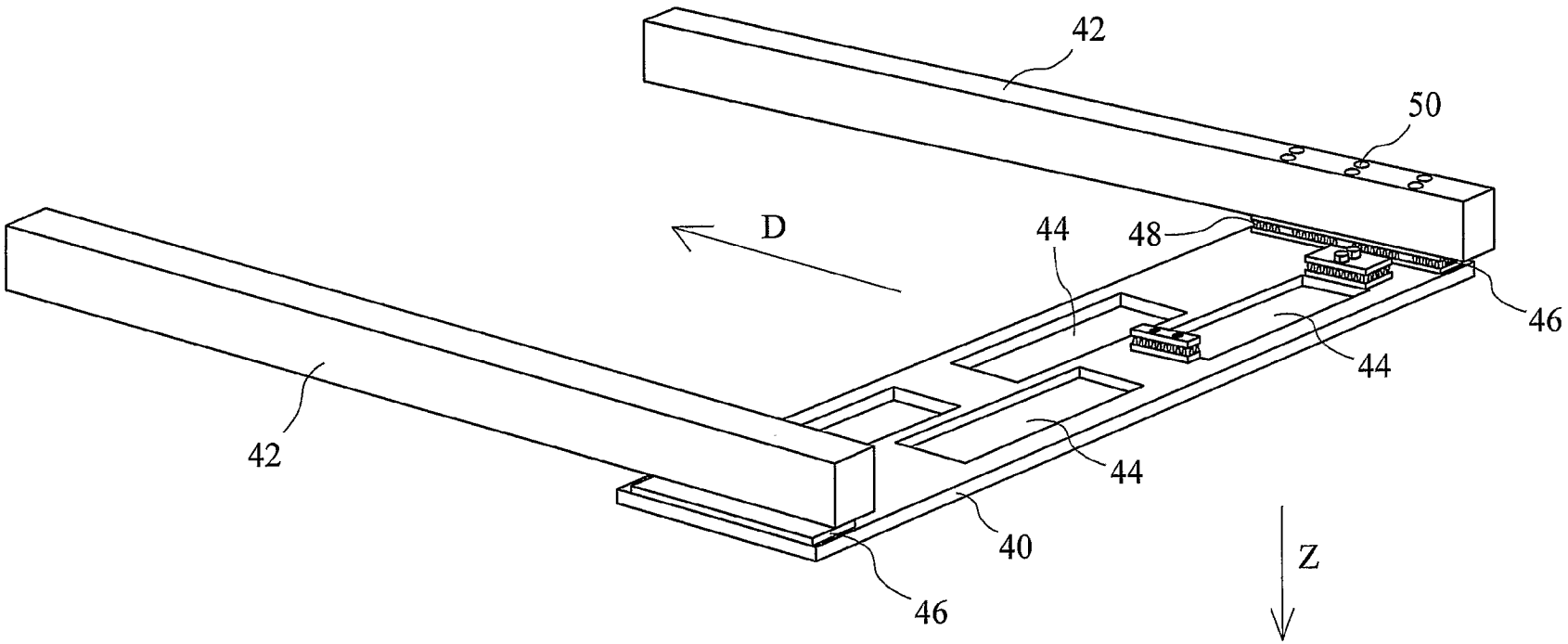
FIG. 7 is a perspective view of a printer support with a mounted print bar.

FIG. 7 depicts a colour printer provided with print bars 40 (only one shown) mounted to a system rail 42. Paper scans under the print bars in the scanning direction D. The print bars form an array in the paper scan direction, each print bar arranged to print a different colour. The print bars are provided with windows 44 through which print head modules are posted and mounted using averaged elastic alignment. Droplets are ejected in direction Z orthogonal to the scanning direction. Each print bar is provided at each end with alignment features 46.

Each system rail 42 is provided with complementary alignment features 48 that are arranged to plug into the alignment features 46. Bores 50 extend through the system rail and open out adjacent the complementary alignment features. Beneficially, this enables adjustment of the print bars from the side of the printer away from the print substrate. Adjustment may therefore be continual i.e. performed during printing or occasional i.e. performed during assembly.

Figure 8:
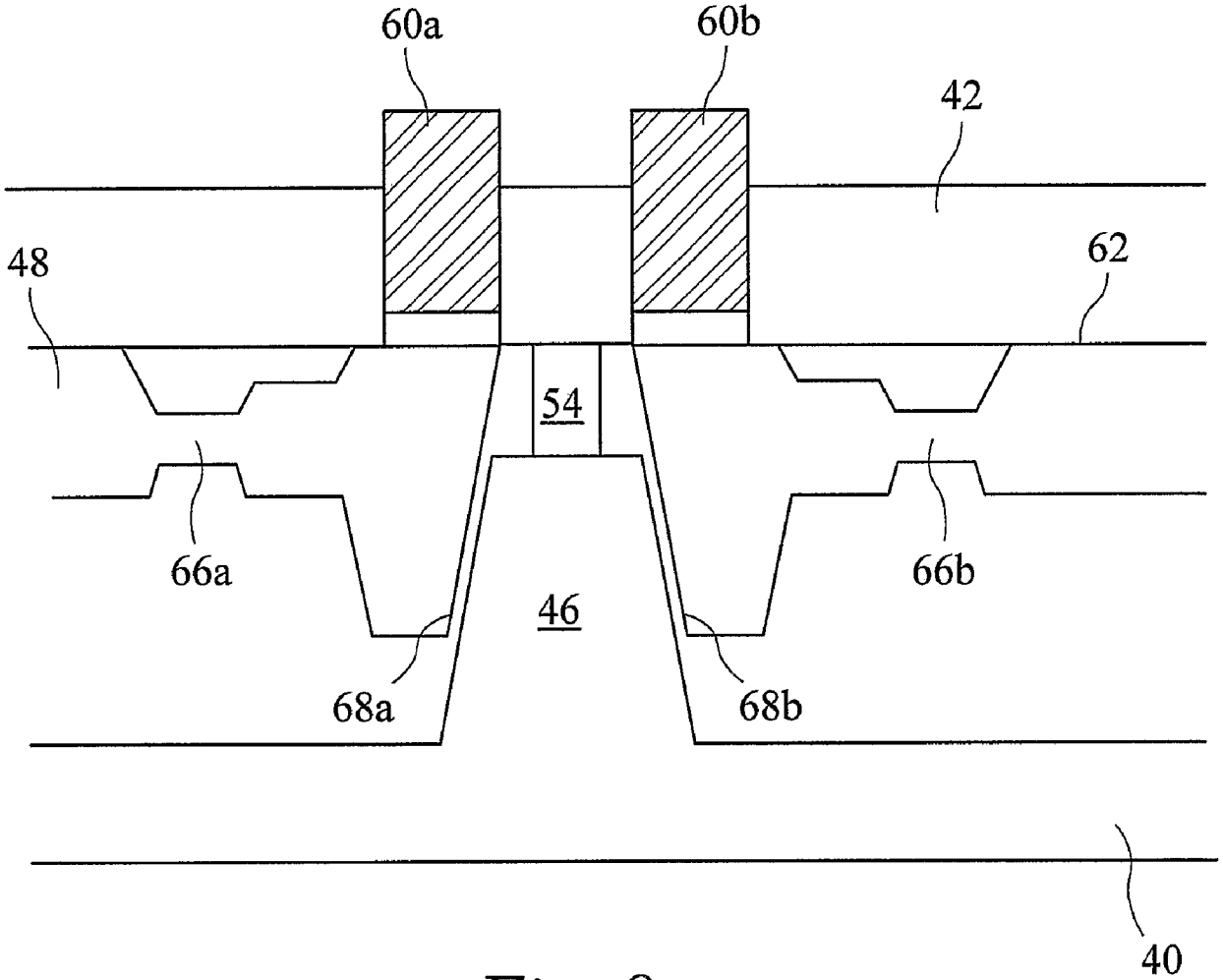
FIG. 8 is a view of an adjustable alignment feature for a interference coupling.

A first embodiment of an adjustable system is depicted in FIG. 8. Adjustment screws 60*a*, 60*b* are inserted into the bores of the system rail 42. The screws, when turned, act upon the complementary alignment features that are bonded to the system rail through adhesive 62. A stop pin 64 is attached to the alignment feature of the print bar to provide alignment in the Z direction.

The complementary alignment features are formed as flexures which can rotate around a point 66*a*, 66*b*. Each flexure has an angled face 68*a*, 68*b* that abuts an alignment feature 46 on the print bar. Rotating screw 60*a* or 60*b* pushes the flexures around point 66*a* or 66*b* respectively. The rotation affects the location of the angled faces 68*a* and 68*b* and adjusts the position of the alignment feature of the print bar. The movement of the alignment feature 46 alters the mean sample position and the print bar is moved with respect to the system rail a distance that is the movement of the individual alignment feature moved averaged over the number of alignment features. Very precise movements of the print bar are therefore possible.

Figure 9:
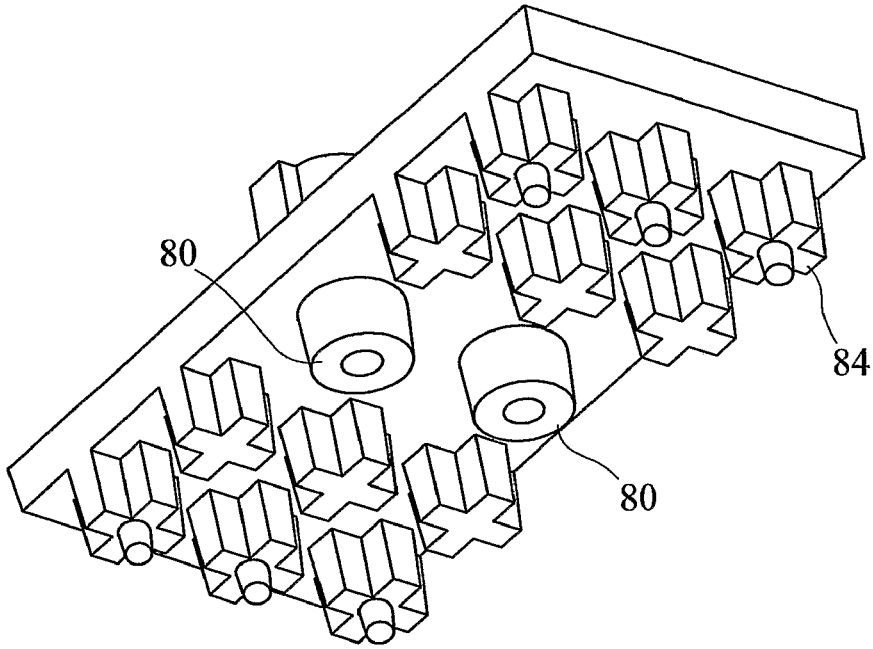
FIG. 9 is a perspective view of alignment features having adjustability.
Figure 9:
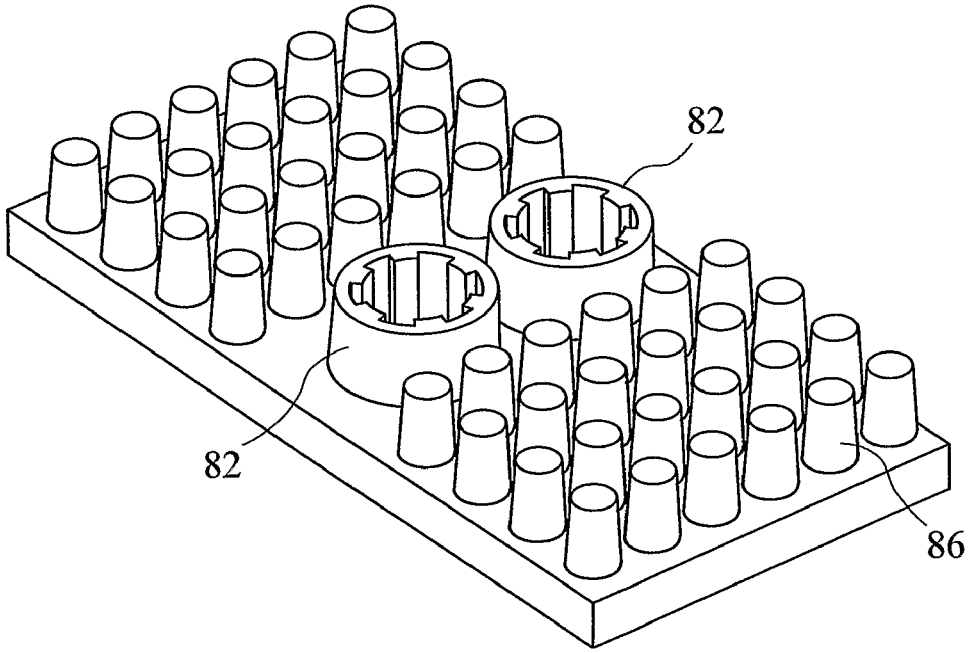

A further embodiment for an adjustable system is depicted with reference to FIG. 9. A first component comprises a series of alignment features 84 having a "cross" cross-section. The second component comprises conical posts 86 arranged to accept the cross-shaped alignment features. A mixture of posts and crosses may be provided on each component. At least one of the cross-shaped alignment features or the posts are elastic and thus are either compressed or stretched to provide interference couplings.

The averaged elastic alignment ensures that the components are accurately aligned around the pattern centre.

The adjusting features 80,82 will now be described in greater detail. These features are also elastic averaging features and arranged to provide interference couplings. The features 80 on the first component are arranged at a different pitch to the features 82 on the second component. Upon insertion of the first feature 80 into its complementary feature 82 each feature (80,82) is deflected.

By altering the stiffness of one of these couplings relative to the stiffness of the other coupling it is possible to alter the position of the first component relative to the second component. Inserting a pin or screw into the couplings to an appropriate depth it is possible to control the relative stiffness of the couplings. Since the movement of the first component relative to the second component works against all the alignment features the movement will be small and can therefore be controlled accurately.

During operation of a long print head there is usually a change in temperature of the print head and hence a degree of expansion in the X direction. A proportion of the expansion may be controlled by the elastic alignment features but in other cases it will be beneficial to allow the print head to freely move. In these cases it is beneficial to provide alignment features that fix one end and also prevent movement in the Y-axis and rotation.

Figure 10:
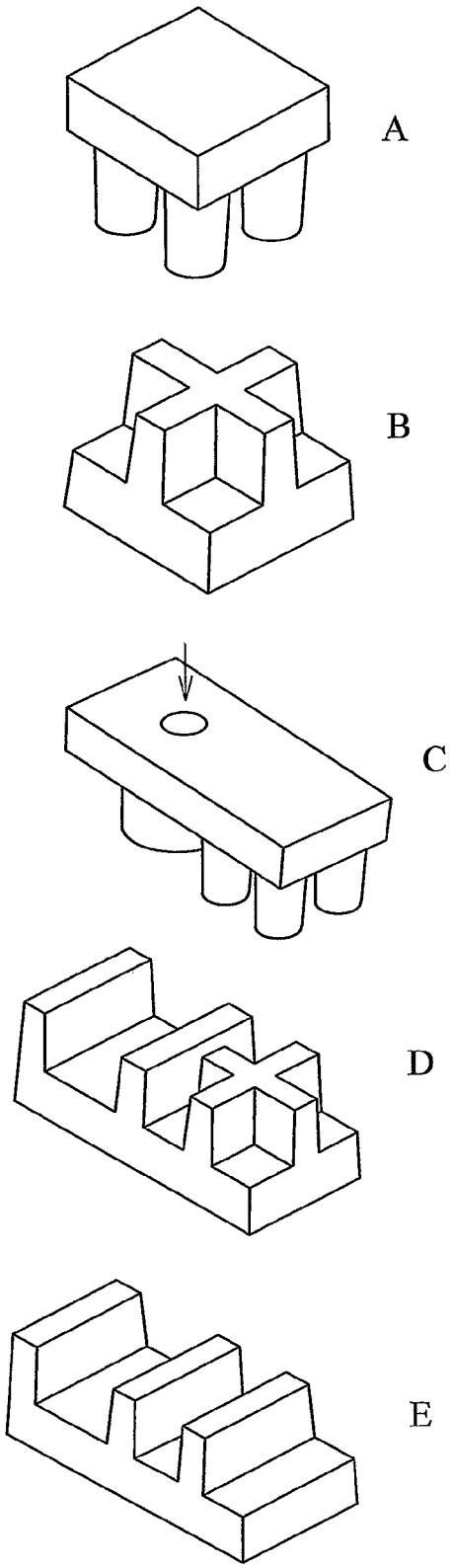
FIG. 10 depicts a plurality of alignment feature modules.

A plurality of components may be used to achieve this function. These components are depicted in FIG. 10. Component A and Component B may be combined to provide alignment in both the X and Y axis. Components C and D may be combined to provide alignment in both the X and Y axis and a degree of adjustability in the X axis.

Component E and Component C may be combined to provide alignment and adjustability in the X axis, while allowing translation in the Y axis.

Figure 11:
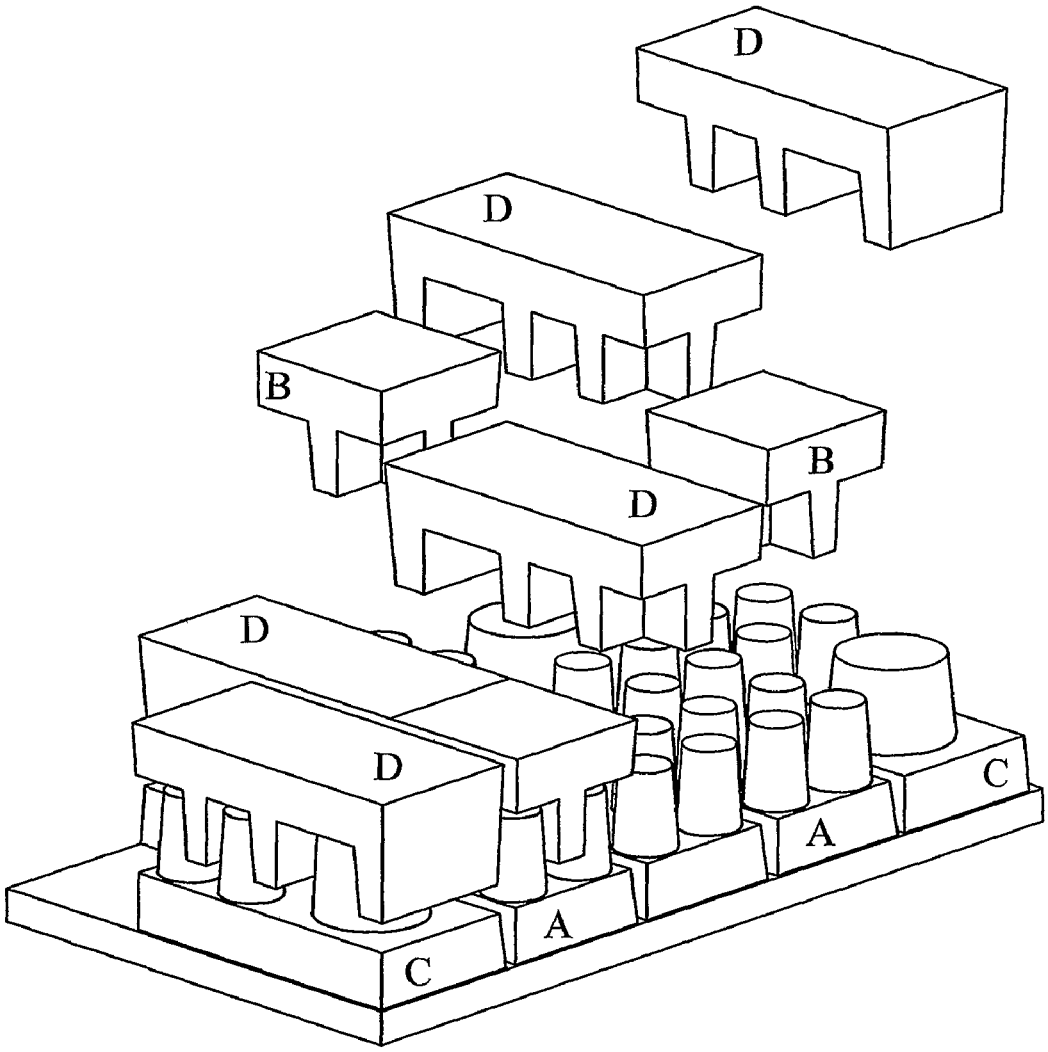
FIG. 11 depicts the alignment feature modules of FIG. 10 mounted to a chassis.

A plurality of these modules may be combined to provide an appropriate functionality as depicted in FIG. 11.

While the present invention has been described with reference to inkjet printers the invention is equally applicable to other forms of printers too e.g. laser or thermal printers. The manufacturing techniques described herein may also be applicable to non-printing applications.

The invention claimed is:

1. A method of manufacturing a printer which has a chassis and at least one printhead module removable from the chassis for maintenance or replacement, the or each module having a print element and having a prescribed position relative to the chassis defined with respect to that print element of the module, the correct functioning of the printer being dependent on the maintenance within predefined tolerance of the positioning error for any module between actual and prescribed positions, the method comprising the steps of:

providing a population of printhead modules, each having a plurality of alignment features, each module having an alignment error in the print element relative to each module alignment feature of the module, the variance over the population in said alignment error significantly exceeding said predefined tolerance;

providing a succession of chassis for use in the manufacture of successive printers, each chassis comprising a plurality of complementary alignment features; and engaging the alignment features of each module from the population with the complementary alignment features of the associated chassis thereby forming n elastic interference couplings for each module;

wherein the variance in said position error over the succession of manufactured printers is significantly less than the variance in said alignment error over the population of modules.

2. A method according to claim 1, wherein said variance in said position error over the succession of manufactured printers is approximately $1/\sqrt{n}$ times the variance in said alignment error over the population of modules.

3. A method according to claim 1, wherein the alignment features are elastic.

4. A method according to claim 3, wherein the elasticity of the alignment features is greater than an elasticity of the complementary alignment features.

5. A method according to claim 1, wherein the complementary alignment features are elastic.

6. A method according to claim 1, comprising forming the n interference couplings by bringing together $n_1$ alignment features and $n_2$ complementary alignment features.

7. A method according to claim 6, wherein $n_1=n$.

8. A method according to claim 6, wherein $n_1>n_2$.

9. A method according claim 1, wherein the print element in an actuator element.

10. A method according to claim 1, wherein the print element is a nozzle.

11. A method according claim 1, wherein the step of engaging any one alignment feature of each module with the complementary alignment feature of the associated chassis serves to create a fluid-tight communication between the chassis and the module for the supply of ink to the module.

12. A method according to claim 1, wherein comprising selectively adjusting the stiffness of one or more of the interference couplings.

13. A method of manufacture, said method comprising the steps:

providing a module comprising a plurality of elastic alignment features, providing a base comprising a plurality of first complementary alignment features, and bringing the module and the base into contact such that said elastic alignment features and said first complementary alignment features form $n_1$ first interference couplings, with the elasticity of said elastic alignment features serving to average the alignment effect on the module of said first interference couplings;

performing a manufacturing action on said module at one or more locations relative to a datum on the base, breaking said interference couplings thereby removing the module from said base, and providing a chassis comprising a plurality of second complementary alignment features, and bringing the module and the chassis into contact such that said elastic alignment features and said second complementary alignment features form $n_2$ second interference couplings, with the elasticity of said elastic alignment features serving to average the alignment effect on the module of said first interference couplings.

14. A method according to claim 13, wherein the first complementary alignment features are significantly stiffer than the alignment features.

15. A method according to claim 13, wherein $n_1=n_2$.

16. A method according to claim 13, wherein $n_1$ is at least 4.

17. A method according to claim 16, wherein $n_1$ is at least 8.

18. A method according claim 13, comprising forming an interference coupling by bringing together an equal number of alignment features and complementary alignment features.

19. A method according claim 13, wherein the first complementary alignment features and the second complementary alignment features have the same dimensions and shape.

20. A method according claim 13, further comprising the steps of:

providing a second base comprising a plurality of third complementary alignment features, bringing the module and the base into contact such that said elastic alignment features and said third complementary alignment features form $N_3$ third interference couplings, performing a manufacturing action on said module at one or more locations relative to a datum on the second base, and breaking said third interference couplings, thereby removing the module from said base.

21. A method according to claim 20, wherein the manufacturing action is the formation of at least one nozzle.

22. A method according to claim 20, wherein the manufacturing action is the manufacture of an ejection actuator by sawing or deposition.

23. A method according to claim 13, wherein the module comprises a print head module.

24. A printer having a chassis and a plurality of printhead modules each removable from the chassis for maintenance or replacement, each module having a print element and having a prescribed position relative to the chassis defined with respect to that print element of the module, the correct functioning of the printer being dependent on the maintenance within predefined tolerance of the positioning error for any module between actual and prescribed positions, wherein each module has a plurality of module alignment features and an alignment error in the print element relative to each module alignment feature, the chassis comprising for each module a plurality of complementary chassis alignment features, engagement between the alignment features of each module with the complementary alignment features of the chassis forming n elastic interference couplings for each module; wherein the variance in said position error over the modules of the printer is significantly less than the variance in said alignment error over the modules.

25. A printer according to claim 24, wherein said variance in said position error over the modules of the printer is approximately $1/\sqrt{n}$ times the variance in said alignment error over the modules.

26. A printer according to claim 24, wherein the module alignment features are elastic.

27. A printer according to claim 26 wherein the elasticity of the module alignment features is greater than an elasticity of the chassis alignment features.

28. A printer according to claim 24, wherein the complementary chassis alignment features are elastic.

29. A printer according to claim 24, wherein the engagement of a module alignment feature with the complementary chassis alignment feature serves to create a fluid-tight communication between the chassis and the module for the supply of ink to the module.

30. A printer according to claim 24, wherein one or more of the interference couplings is selectively adjustable to control the position of a replaced module.

* * * * *